US009332865B1

(12) United States Patent
Mason

(10) Patent No.: US 9,332,865 B1
(45) Date of Patent: May 10, 2016

(54) FLOOR STAND AND COUNTER TOP DISPLAY UNIT

(71) Applicant: NEW DIMENSIONS RESEARCH CORPORATION, Melville, NY (US)

(72) Inventor: Timothy L. Mason, Melville, NY (US)

(73) Assignee: New Dimensions Research Corporation, Melville, NY (US)

( * ) Notice: Subject to any disclaimer, the term of this patent is extended or adjusted under 35 U.S.C. 154(b) by 0 days.

(21) Appl. No.: 14/516,184

(22) Filed: Oct. 16, 2014

(51) Int. Cl.

| | |
|---|---|
| ***A47F 3/14*** | (2006.01) |
| ***A47J 47/00*** | (2006.01) |
| ***A47F 5/10*** | (2006.01) |
| ***A47F 5/00*** | (2006.01) |

(52) U.S. Cl.
CPC ..... *A47F 5/10* (2013.01); *A47F 5/0018* (2013.01)

(58) Field of Classification Search
CPC ..... A47F 5/10; A47B 87/0223; A47B 43/00
See application file for complete search history.

(56) References Cited

U.S. PATENT DOCUMENTS

D150,315 S 7/1948 Richards
2,483,606 A * 10/1949 Albach ..... A47B 47/03 312/257.1
2,934,214 A * 4/1960 Mogulescu ..... A47F 5/10 211/126.12
3,788,241 A * 1/1974 Ravreby ..... A47F 7/08 708/158.12
4,125,304 A * 11/1978 Ebert ..... A47B 47/042 16/254
4,127,072 A 11/1978 Le Pon
4,428,487 A * 1/1984 Hepp ..... A47B 87/0246 108/180
4,474,416 A * 10/1984 Rogahn ..... A47B 81/06 108/157.13
4,691,644 A * 9/1987 Frydman ..... A47B 47/03 108/155
4,981,224 A * 1/1991 Rushing ..... A47B 87/0223 211/126.12
5,238,128 A * 8/1993 Stoddard ..... A47F 5/005 211/133.1
5,240,127 A 8/1993 Levin et al.
5,368,380 A * 11/1994 Mottmiller ..... A47B 47/0075 312/111
5,382,087 A * 1/1995 Pouch ..... A47B 73/00 160/135
5,433,326 A * 7/1995 Horian ..... A47B 47/00 211/188
5,566,961 A * 10/1996 Snell ..... A47B 31/00 220/4.31
5,590,939 A * 1/1997 Piontek ..... A47B 13/06 108/25
5,722,544 A * 3/1998 Williams ..... A47B 87/0246 108/107
5,975,660 A * 11/1999 Tisbo ..... A47B 87/0207 312/108
6,099,092 A * 8/2000 Uffner ..... A47B 47/00 16/374
6,113,203 A * 9/2000 Chen ..... A47B 43/00 312/258
6,202,867 B1 * 3/2001 Di Blasi ..... A47B 47/0075 108/138
D451,024 S 11/2001 Glauth et al.
6,474,759 B2 * 11/2002 Hsu ..... A47B 47/042 312/108
6,520,356 B2 * 2/2003 Miller, Jr. ..... A47F 5/10 108/106
6,695,418 B2 * 2/2004 Skov ..... A47B 87/0276 108/147.13
6,752,278 B2 * 6/2004 Craft ..... A47B 81/00 211/14
6,764,144 B2 * 7/2004 Insalaco ..... A47B 47/05 312/108
D520,265 S 5/2006 Sparkowski
D537,655 S 3/2007 Hessell
D541,558 S * 5/2007 Meyer ..... D6/675.1
7,293,785 B2 * 11/2007 Bush ..... B62B 3/16 280/47.34
D565,324 S 4/2008 Sparkowski
D584,538 S 1/2009 Weigand et al.
D615,777 S 5/2010 Lee et al.

(Continued)

*Primary Examiner* — Joshua Rodden
*Assistant Examiner* — Kimberly S Wright
(74) *Attorney, Agent, or Firm* — Collard & Roe, P.C.

(57) ABSTRACT

A modular display unit can be configured as a counter top display unit or a floor stand display unit. The display unit includes a first tray and a second tray disposed over and spaced apart from the first tray. Vertical support members are disposed between the first and second trays and include side panels and rear panels hingedly coupled to the side panels. The vertical support members also include lower tabs engaging associated receiving slots of the first tray and upper tabs engaging associated receiving slots of the second tray.

13 Claims, 10 Drawing Sheets

(56) References Cited

U.S. PATENT DOCUMENTS

| | | | |
|---|---|---|---|
| D635,801 | S | 4/2011 | Stubis |
| D644,452 | S | 9/2011 | Naples et al. |
| 8,079,313 | B2 | 12/2011 | Sparkowski |
| D657,591 | S | 4/2012 | Sanchez |
| D676,686 | S | 2/2013 | Lim |
| D676,687 | S | 2/2013 | Lim |
| D716,080 | S | 10/2014 | Bell et al. |
| D718,560 | S | 12/2014 | Denby et al. |
| D731,823 | S | 6/2015 | Kelinske et al. |
| 9,266,547 | B2 * | 2/2016 | Schumaker ..... B62B 3/005 |
| 2006/0108899 | A1 * | 5/2006 | Jin ..... A47B 43/00 312/257.1 |
| 2008/0061019 | A1 * | 3/2008 | Lin ..... A47B 47/0091 211/187 |
| 2008/0128319 | A1 * | 6/2008 | Noble Colin ..... A47F 5/10 206/745 |
| 2009/0107939 | A1 * | 4/2009 | Liao ..... A47F 5/10 211/134 |
| 2013/0048588 | A1 * | 2/2013 | Vilkomirski ..... A47B 87/0215 211/153 |

* cited by examiner

FLOOR STAND AND COUNTER TOP DISPLAY UNIT

BACKGROUND OF THE INVENTION

1. Field of the Invention

The present invention relates to display units for merchandise. In particular, the invention relates to a modular display unit that can be configured as a counter top display unit or a floor stand display unit.

2. The Prior Art

Various display devices for displaying items of merchandise to potential consumers are known.

A need exists, however for a modular display unit which can be readily assembled in various configurations, including a counter top display unit and a floor stand display unit. A need further exists for a lightweight, high strength display unit which can accommodate a wide variety of merchandise of various types by positioning horizontal tray and/or shelf elements and hanging product supports in a suitable configuration.

A need also exists for a display unit which provides enhanced ease of manufacture, shipment and assembly by including hinged universal vertical support members which can be positioned to serve as either right side or left side vertical support members and folded substantially flat to provide a compact, disassembled unit for shipping.

SUMMARY OF THE INVENTION

A display unit is provided. The display unit includes a first tray having a first tray front wall, a first tray rear wall, a first tray first side wall, a first tray second side wall, a first tray upper merchandise support surface, a first tray underside surface and a first tray plurality of tab receiving slots. A second tray is disposed over and spaced apart from the first tray, and includes a second tray front wall, a second tray rear wall, a second tray first side wall, a second tray second side wall, a second tray upper merchandise support surface, a second tray underside surface and a second tray plurality of tab receiving slots.

A first vertical support member is disposed between the first tray and the second tray and includes a first vertical support member side panel, a first vertical support member rear panel, a plurality of first vertical support member lower tabs and a plurality of first vertical support member upper tabs.

The first vertical support member side panel runs substantially parallel and adjacent to the first tray first side wall and second tray first side wall and extends between the first tray upper merchandise support surface and second tray underside surface. The first vertical support member rear panel is hingedly coupled to the first vertical support member side panel, runs substantially parallel and adjacent to the first tray rear wall and second tray rear wall and extends between the first tray upper merchandise support surface and second tray underside surface.

The plurality of first vertical support member lower tabs is disposed on a lower portion of the first vertical support member. Each of the first vertical support member lower tabs engages an associated tab receiving slot of the first tray plurality of tab receiving slots. The plurality of first vertical support member upper tabs is disposed on an upper portion of the first vertical support member. Each of the first vertical support member upper tabs engages an associated tab receiving slot of the second tray plurality of tab receiving slots.

A second vertical support member is disposed between the first tray and the second tray and includes a second vertical support member side panel, a second vertical support member rear panel, a plurality of second vertical support member lower tabs and a plurality of second vertical support member upper tabs.

The second vertical support member side panel runs substantially parallel and adjacent to the first tray second side wall and the second tray second side wall and extends between the first tray upper merchandise support surface and second tray underside surface. The second vertical support member rear panel is hingedly coupled to the second vertical support member side panel, runs substantially parallel and adjacent to the first tray rear wall and second tray rear wall and extends between the first tray upper merchandise support surface and second tray underside surface.

The plurality of second vertical support member lower tabs is disposed on a lower portion of the second vertical support member. Each of the second vertical support member lower tabs engages an associated tab receiving slot of the first tray plurality of tab receiving slots. The plurality of second vertical support member upper tabs is disposed on an upper portion of the second vertical support member. Each of the second vertical support member upper tabs engages an associated tab receiving slot of the second tray plurality of tab receiving slots.

In another aspect, the plurality of first vertical support member lower tabs include a plurality of first vertical support member side panel lower tabs disposed on a lower portion of the first vertical support member side panel, the plurality of first vertical support member upper tabs include a plurality of first vertical support member side panel upper tabs disposed on an upper portion of the first vertical support member side panel and the plurality of first vertical support member side panel lower tabs are arranged offset from the first vertical support member side panel upper tabs.

In another aspect, the first vertical support member side panel is wider than the first vertical support member rear panel.

In another aspect, the first vertical support member side panel has an opening therethrough.

In another aspect, the first vertical support member side panel and said first vertical support rear panel comprise a strengthening rib.

In another aspect, the display unit includes a first dovetail connector disposed on the first tray first side wall and a second dovetail connector disposed on the first tray second side wall. The first dovetail connector may include a male dovetail connector projecting outwardly from the first tray first side wall and the second dovetail connector may include a female dovetail connector projecting into the first tray second side wall.

In another aspect, the display unit includes a plurality of legs extending downwardly from the first tray underside surface.

In another aspect, the display unit includes a middle shelf suspended from the second tray. The middle shelf may be supported by a plurality of middle shelf supports.

In another aspect, the display unit includes a shelf channel disposed on at least one of the first tray front wall and second tray front wall.

In another aspect, the display unit includes a header secured to the second tray. The header may be suspended above the second tray with at least one header support wire.

In another aspect, the display unit includes a plurality of product support bars secured to the second tray underside surface.

In another aspect, the display unit includes a plurality of molded brackets for receiving an associated product support bar.

An advantage of a display unit according to an aspect of the invention is that a modular display unit is provided which can be readily assembled and configured as a counter top display unit or a floor stand display unit. A further advantage of a display unit according to an aspect of the invention is that the display unit is lightweight and high strength and can be adapted to accommodate a wide variety of merchandise of various types by positioning horizontal tray and/or shelf elements and hanging product supports in a suitable configuration.

Another advantage of a display unit according to an aspect of the invention is that the display unit includes hinged universal vertical support members which can be positioned to serve as either right side or left side vertical support members and can be folded substantially flat to provide a compact, disassembled unit for shipping, thereby providing simple and economical manufacture, shipment and assembly.

BRIEF DESCRIPTION OF THE DRAWINGS

Other benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE DRAWINGS

Figure 1:
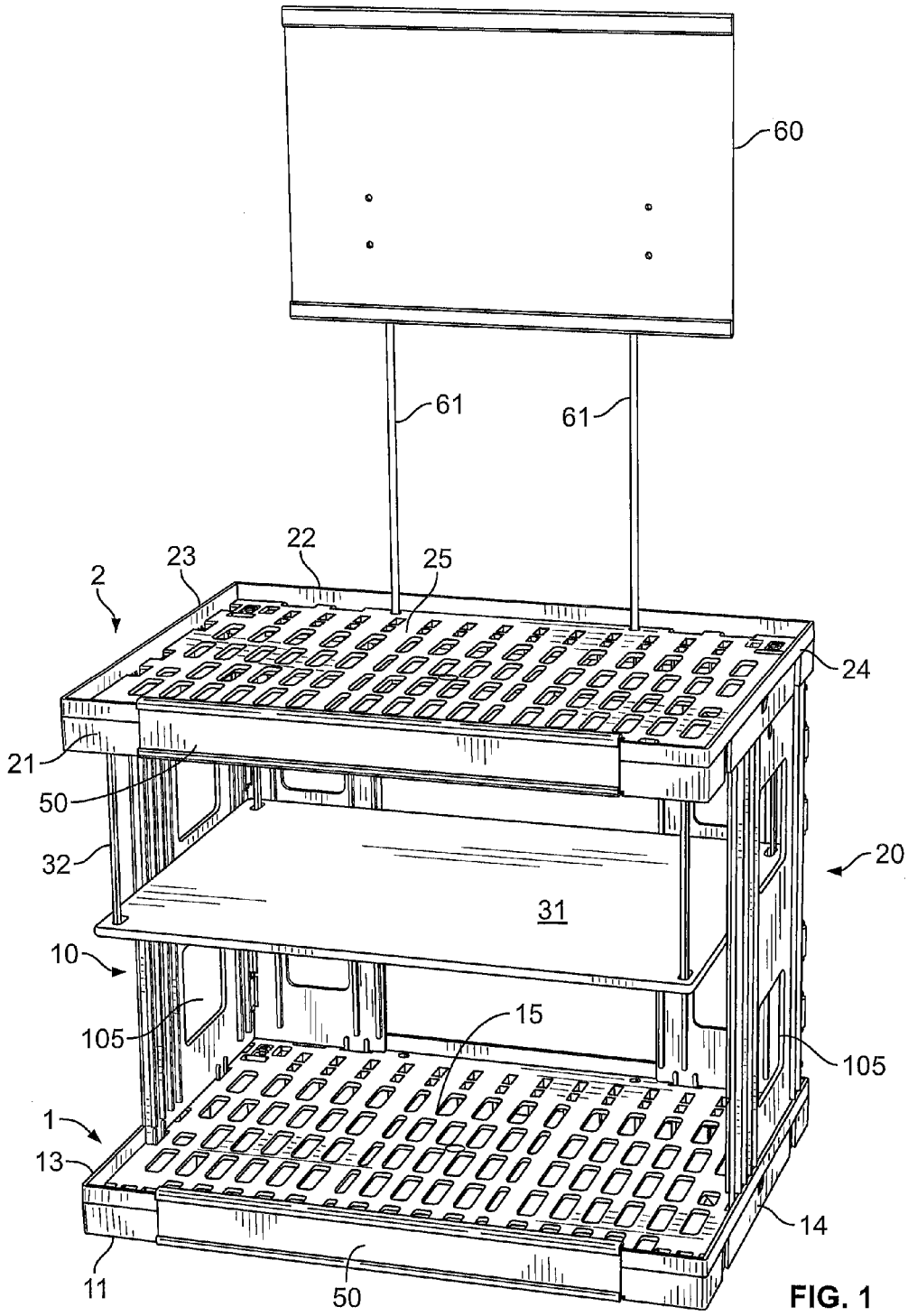
FIG. 1 shows a perspective view of an embodiment of a display unit configured as a counter top display unit in accordance with the invention.
Figure 2:
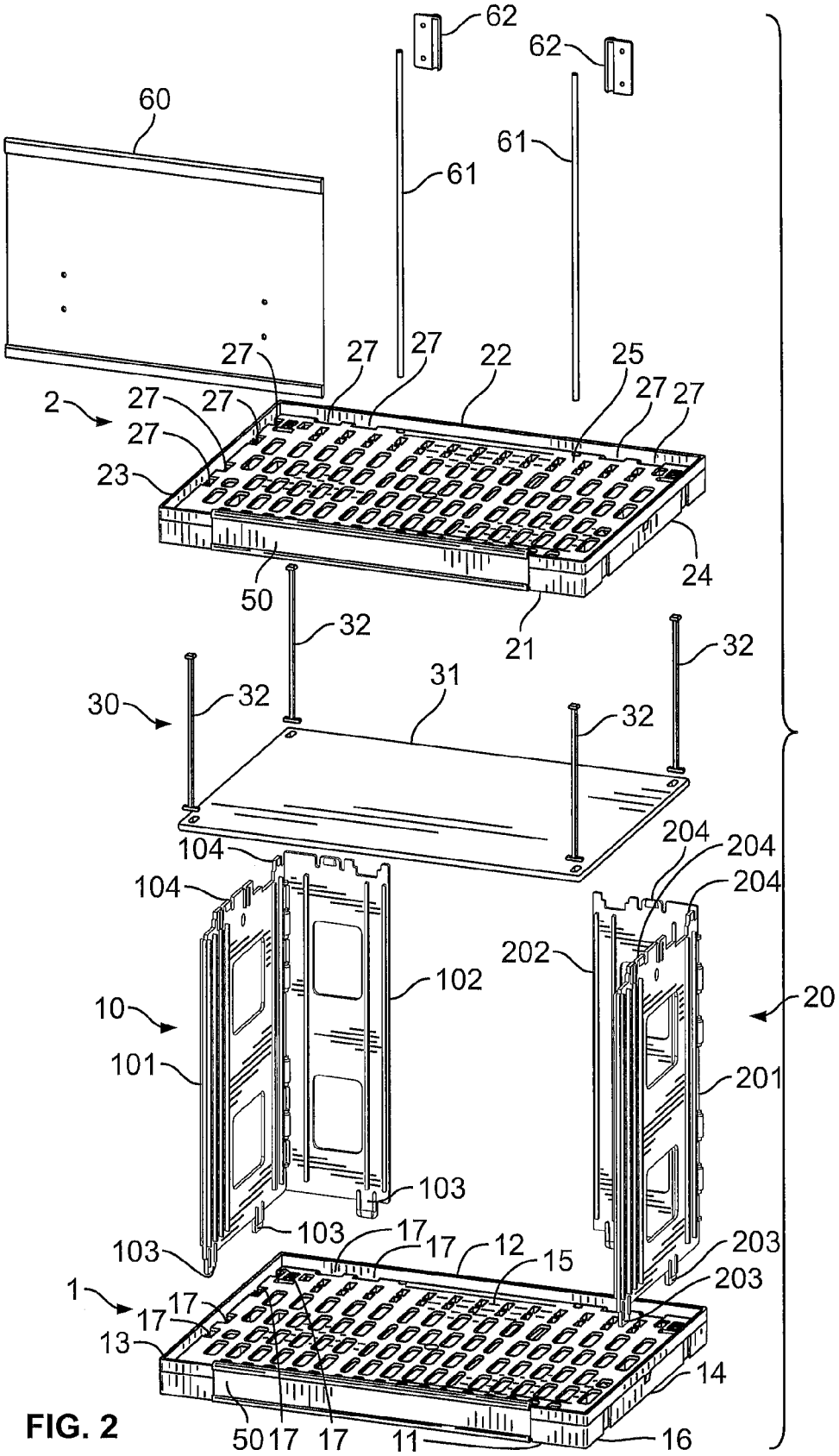
FIG. 2 shows an exploded perspective view thereof.
Figure 3:
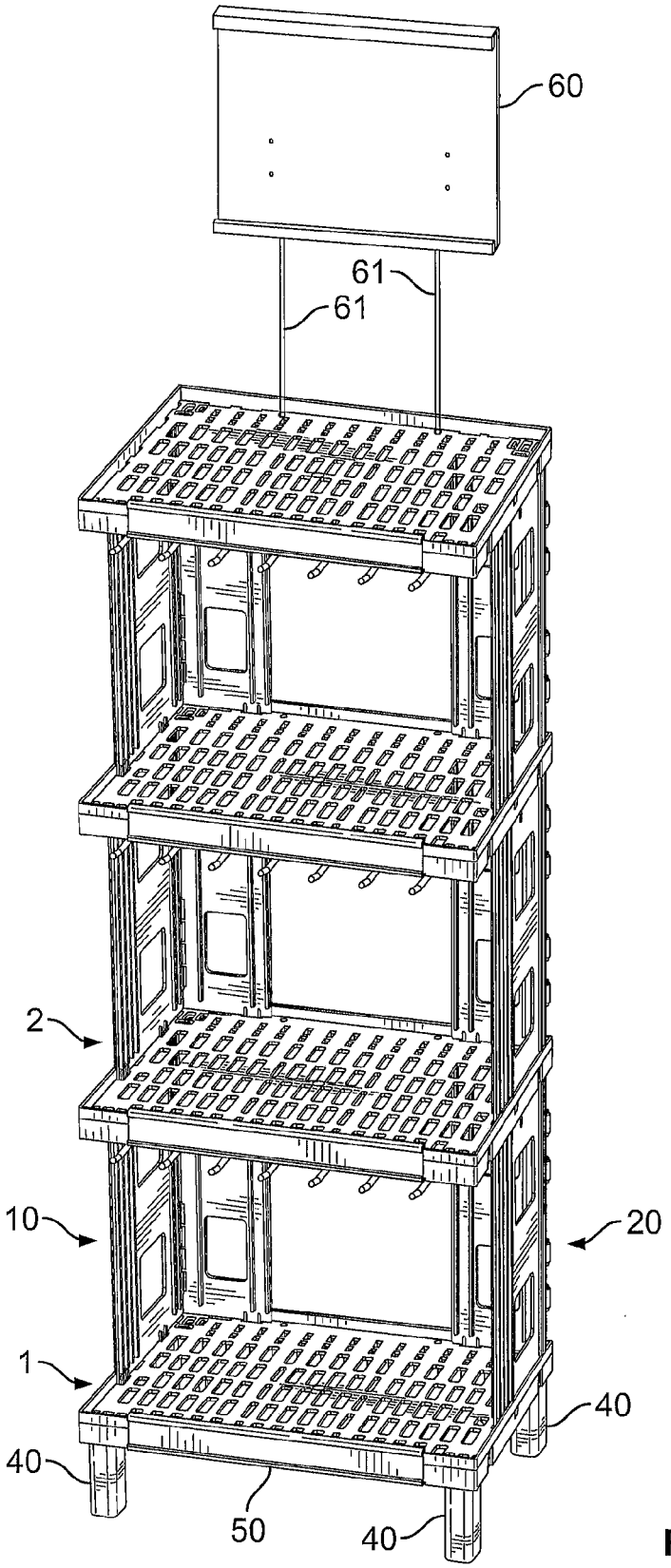
FIG. 3 shows a perspective view of an embodiment of a display unit configured as a floor stand display unit in accordance with the invention.
Figure 4:
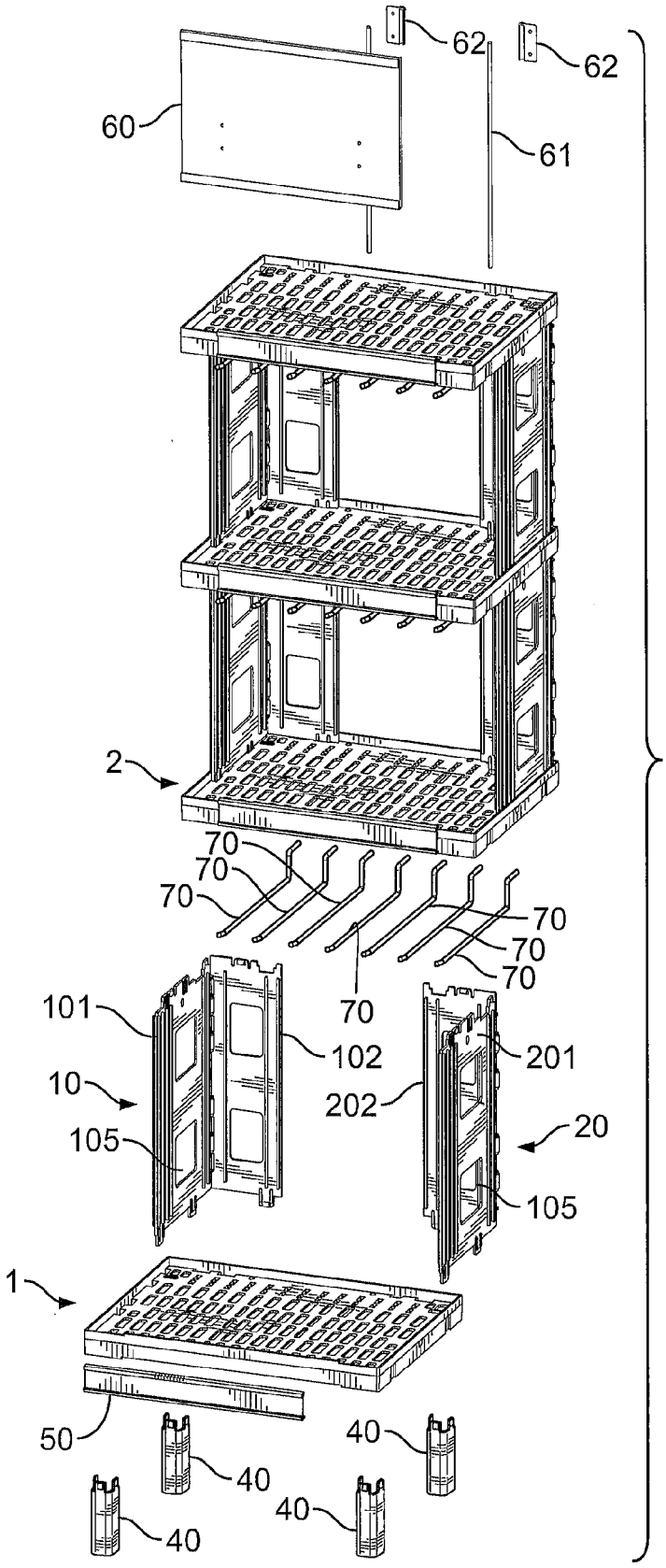
FIG. 4 shows an exploded perspective view thereof.

Turning now to the drawings, FIG. 1 shows a perspective view of a display unit configured as a counter top display unit and FIG. 3 shows a perspective view of a display unit configured as a floor stand display unit. FIGS. 2 and 4 show exploded perspective views of the display unit configured as a counter top display unit and configured as a floor stand display unit, respectively.

The display unit includes a first tray 1 and a second tray 2 disposed over and spaced apart from the first tray 1. First tray 1 includes a first tray front wall 11, a first tray rear wall 12, a first tray first side wall 13, a first tray second side wall 14; a first tray upper merchandise support surface 15, a first tray underside surface 16 and a first tray plurality of tab receiving slots 17. Second tray 2 includes a second tray front wall 21, a second tray rear wall 22, a second tray first side wall 23, a second tray second side wall 24, a second tray upper merchandise support surface 25, a second tray underside surface 26 and a second tray plurality of tab receiving slots 27.

A first vertical support member 10 and a second vertical support member 20 are disposed between the first tray 1 and the second tray 2. The first vertical support member 10 includes a first vertical support member side panel 101 running substantially parallel and adjacent to first tray first side wall 13 and second tray first side wall 23 and extending between the first tray upper merchandise support surface 15 and the second tray underside surface 26. The first vertical support member 10 also includes a first vertical support member rear panel 102 hingedly coupled to first vertical support member side panel 101. The first vertical support member rear panel runs substantially parallel and adjacent to the first tray rear wall 12 and second tray rear wall 22 and extends between the first tray upper merchandise support surface 15 and the second tray underside surface 26.

First vertical support member 10 further includes a plurality of first vertical support member lower tabs 103 disposed on a lower portion of first vertical support member 10. Each of the plurality of first vertical support member lower tabs 103 engages an associated tab receiving slot of the first tray plurality of tab receiving slots 17. First vertical support member 10 further includes a plurality of first vertical support member upper tabs 104 disposed on an upper portion of first vertical support member 10. Each of the plurality of first vertical support member upper tabs 104 engages an associated tab receiving slot of the second tray plurality of tab receiving slots 27.

The second vertical support member 20 includes a second vertical support member side panel 201 running substantially parallel and adjacent to first tray second side wall 14 and second tray second side wall 24 and extending between the first tray upper merchandise support surface 15 and the second tray underside surface 26. The second vertical support member 20 also includes a second vertical support member rear panel 202 hingedly coupled to second vertical support member side panel 201. The second vertical support member rear panel 202 runs substantially parallel and adjacent to the first tray rear wall 12 and second tray rear wall 22 and extends between the first tray upper merchandise support surface 15 and the second tray underside surface 26.

Second vertical support member 20 further includes a plurality of second vertical support member lower tabs 203 disposed on a lower portion of second vertical support member 20. Each of the plurality of second vertical support member lower tabs 203 engages an associated tab receiving slot of the first tray plurality of tab receiving slots 17. Second vertical support member 20 further includes a plurality of second vertical support member upper tabs 204 disposed on an upper portion of second vertical support member 20. Each of the plurality of second vertical support member upper tabs 204 engages an associated tab receiving slot of the second tray plurality of tab receiving slots 27.

As shown, for example in FIGS. 1-4, first vertical support member 10 may be positioned at a left side rear corner of the display unit and second vertical support 20 may be positioned at a right side rear corner of the display unit. When configured as a counter top display unit, as shown for example in FIG. 1, the display unit may include a first lower tray 1, a second upper tray 2 and a pair of vertical support members 10, 20. When configured as a floor stand display unit, as shown for example in FIG. 3, additional trays and vertical support members as previously described may be added to provide greater height and additional product display space via the additional trays or shelves. For example, a floor stand display unit according to an embodiment of the invention may include four tray arranged one over another and spaced apart and supported by three pairs of corresponding vertical support members.

When configured a floor stand display unit, a plurality of legs 40 may be provided which extend downwardly from the first tray underside surface 16. Preferably, four legs or feet 40 are provided. Legs 40 may be molded legs and may be secured to first tray 1 using a snap fit or any other suitable securing means.

When configured as a counter top display unit, first tray underside surface 16 may include a plurality of downwardly extending bosses. Rubber pads may be secured to each of the bosses using adhesive or other suitable means in order to prevent slipping of the counter top display unit or damage to the count top upon which the unit is placed.

During assembly of the display unit, first and second vertical support member 10, 20 are positioned such their respective vertical support member rear panel and side panel portions are substantially perpendicular and form an angle of substantially 90 degrees to one another. The two vertical support members 10, 20 may be placed upside down on a hard surface and the first tray 1 is aligned such that first tray tab receiving slots 17 are aligned with the respective vertical support member lower tabs 103, 203. Sufficient downward force is exerted on the tray 1 to provide a solid snap fit for each of the tabs 103, 203. This process may be repeated in order to provide additional tray and vertical support member assemblies as needed. For example, three such tray and vertical support member assemblies may be assembled when configuring the display unit as a floor stand unit.

Figure 5:
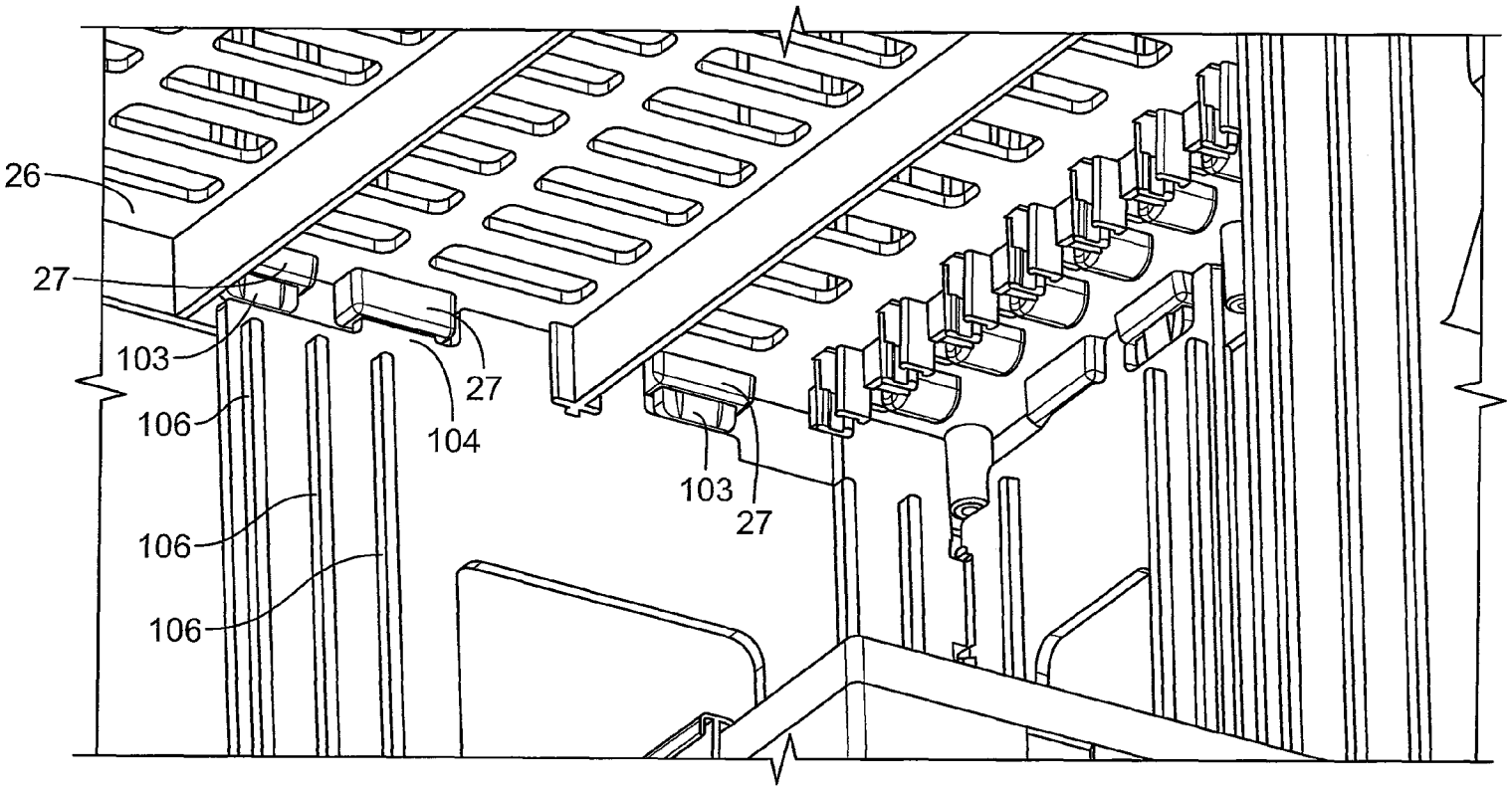
FIG. 5 shows a detailed perspective view of a portion of a display unit with the upper and lower tabs of a vertical support member engaging associated tab receiving slots of a tray in accordance with the invention.

FIG. 5 shows a detailed view of the engagement of vertical support member upper tabs 104 with second tray 2 tab receiving slots 27 and the engagement of a further vertical support member lower tabs 103 with the second tray tab receiving slots 27. The tabs 103, 104 may include angled projections which angle outwardly from a surface of the tab and provide a secure snap fit engagement of the respective tabs and tab receiving slots.

The trays and vertical support members may be made from any suitable rigid material. Preferably, the trays and/or vertical support members are made from a lightweight, high strength plastic such as, for example, styrene or ABS plastic. The design and materials of the display unit allow for superior load bearing capacity. For example a floor stand unit may be capable of supporting approximately 15 pounds of merchandise per tray (shelf) and a floor stand display unit configured with four trays and an optional middle shelf assembly as described below may be capable of supporting approximately 84 pounds of merchandise. A counter top display unit configured with one lower tray and one upper tray may be capable of supporting over 40 pounds of merchandise. Moreover, as the bottom tray of the counter top display unit sits on a counter top, the bottom tray can support substantially more weight than the upper tray.

The strength of the unit may be further enhanced by providing the vertical support members 10, 20 with strengthening ribs 106. Strengthening ribs 106 may be provided on one or both of the respective side panels and rear panels of the vertical support members on one or both sides of the respective panel. The strengthening ribs 106 may extend in a vertical orientation along the vertical support member side or rear panel.

The vertical support member side panels 101, 201 may be of equal width, narrower or wider than the associated vertical support member rear panels 102, 202. Additionally, the vertical support member side panels 101, 201 and/or vertical support member rear panels may have one or more openings 105 therethrough which may allow for improved visibility of the merchandise supported on the display unit.

The hinged configuration of the vertical support members 10, 20, wherein the side panels are coupled to the rear panels with a hinge member provides a number of benefits. In particular, the hinged design of the vertical support members allows identical vertical support members to be used as universal supports which can be configured to serve on either side of the display unit, left or right, by pivoting the side panel and rear panel relative to one another into the proper orientation. This provision of a hinged universal vertical support member reduces manufacturing cost and complexity.

Figure 11:
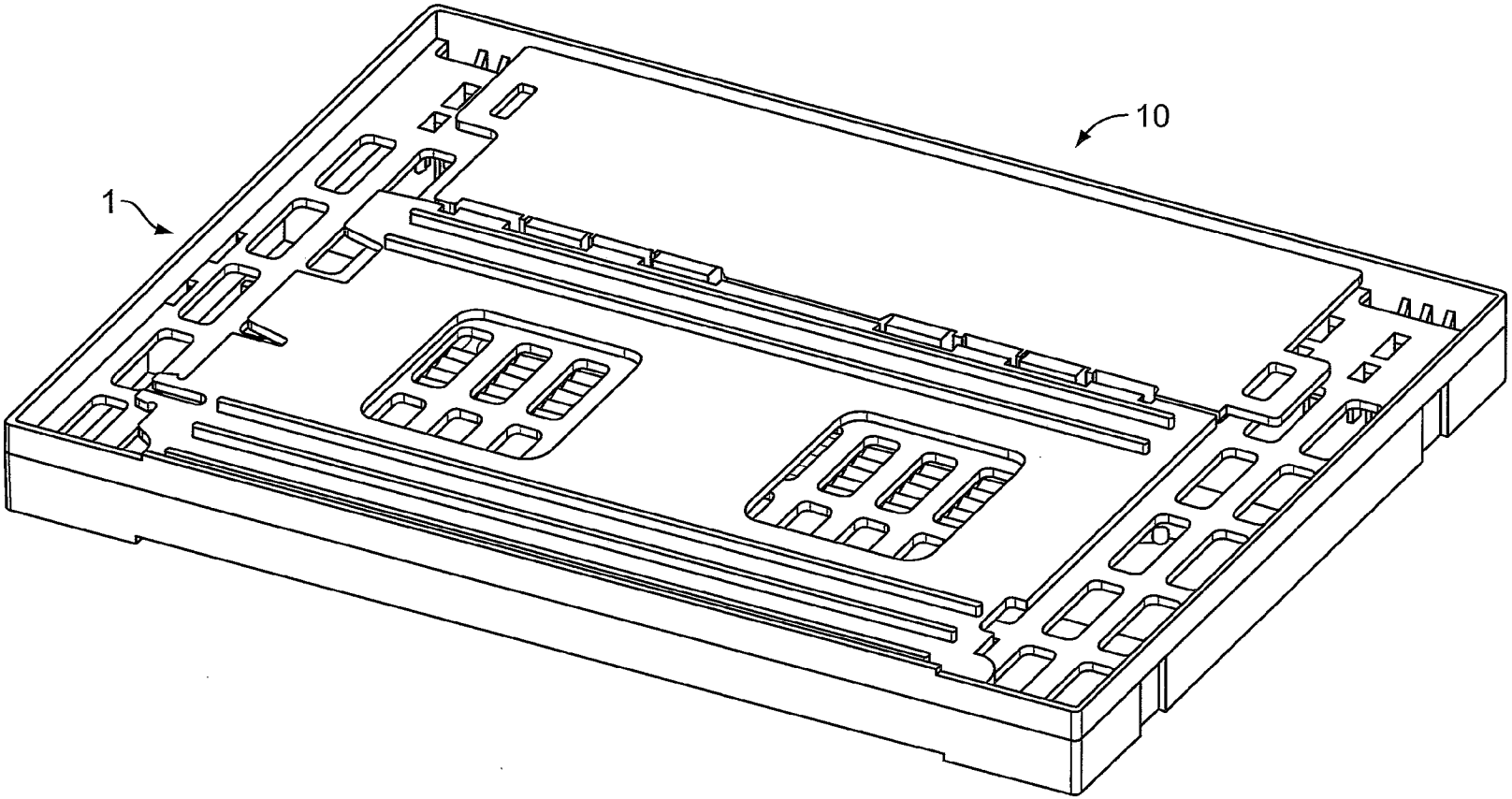
FIG. 11 shows a perspective view of some components of a display unit according to an embodiment of the invention with a vertical support member folded flat and placed inside the top of a tray for packing and shipping.

Moreover, the vertical support member 10 can be folded flat, as shown in FIG. 11 and placed inside the top of a tray 1 for packing and shipping. This feature allows for very compact and efficient packing, reducing packing and transportation costs.

The first and second vertical support member lower tabs may include one or more vertical support member side panel lower tabs disposed on a lower portion of the respective vertical support member side panel and/or one or more vertical support member rear panel lower tabs disposed on a lower portion of the respective vertical support member rear panel. Likewise, the first and second vertical support member upper tabs may include one or more vertical support member side panel upper tabs disposed on an upper portion of the respective vertical support member side panel and/or one or more vertical support member rear panel upper tabs disposed on an upper portion of the respective vertical support member rear panel.

The lower tabs may be offset from the corresponding upper tabs on the associated vertical support member side panel or rear panel such that the upper tabs of one vertical support member and the lower tabs of a vertically adjacent vertical support member can engage the tab receiving slots of a common tray, as shown for example in FIG. 5. For example, vertical support member side panel lower tabs 103 engaging a tray from above may be arranged offset from vertical support member side panel upper tabs 104 of a another vertical support member engaging the same tray from below.

Figure 6:
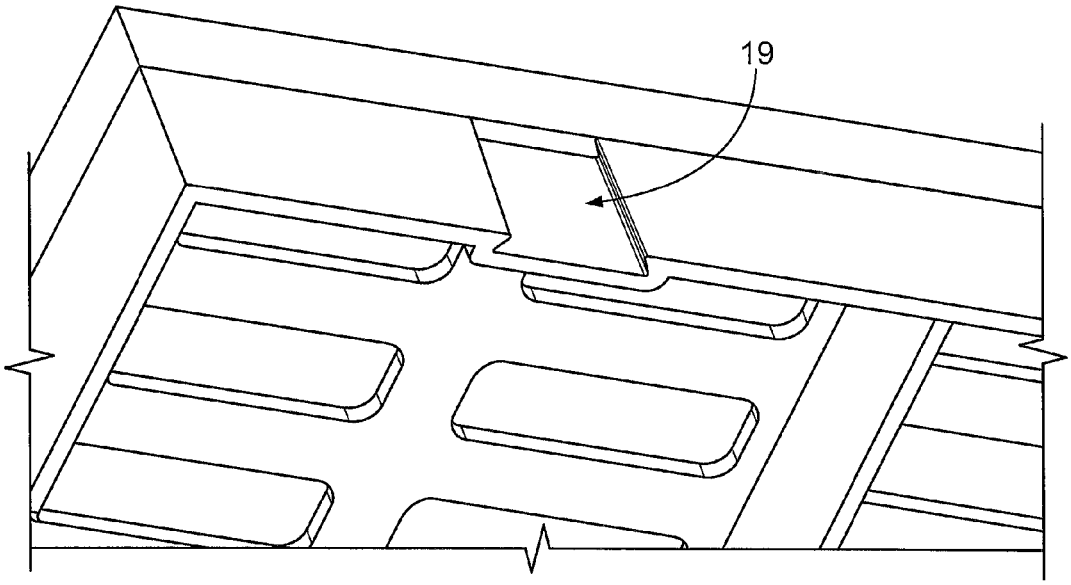
FIG. 6 shows a detailed perspective view of a portion of a display unit tray with a female dovetail connector in accordance with an embodiment of the invention.
Figure 7:
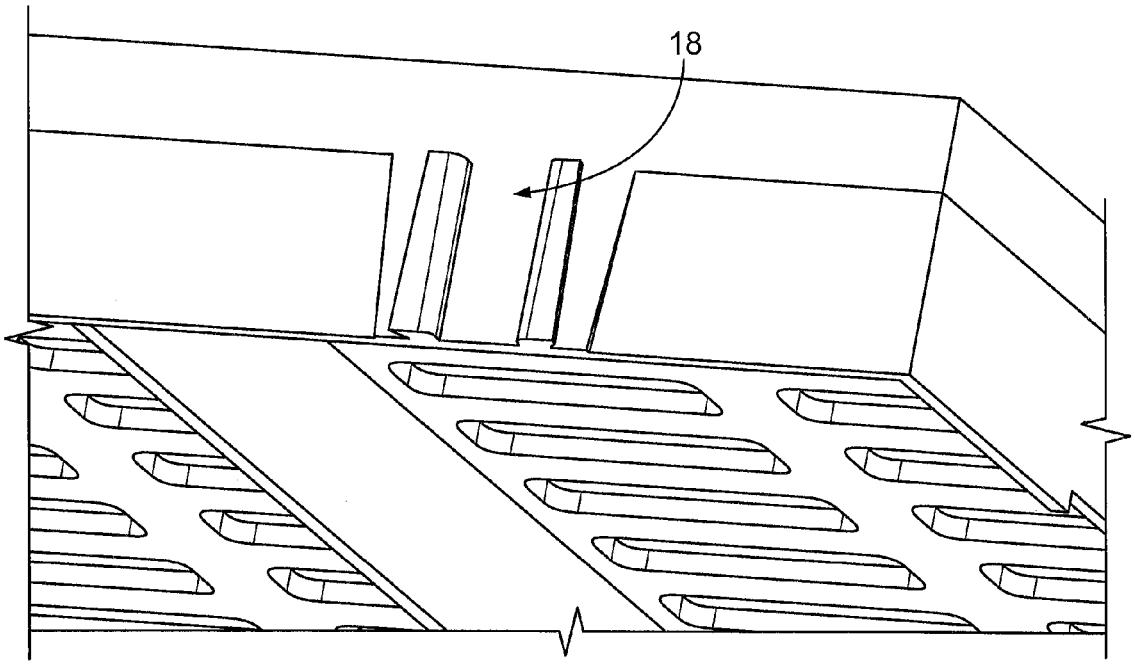
FIG. 7 shows a detailed perspective view of a portion of a display unit tray with a male dovetail connector in accordance with an embodiment of the invention.
Figure 8:
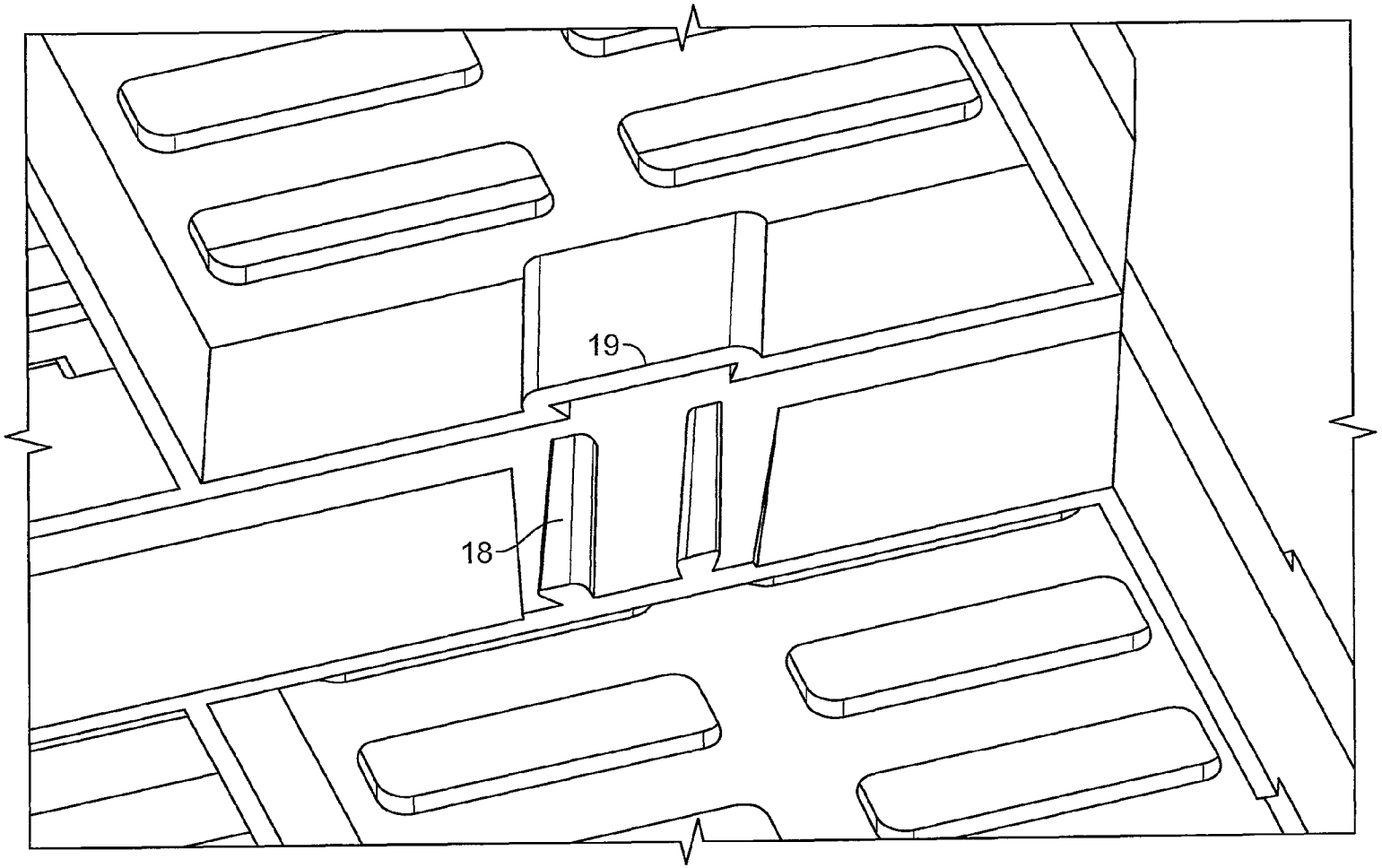
FIG. 8 shows a detailed perspective view of a portion of adjacent trays with associated male and female dovetail connectors.
Figure 9:
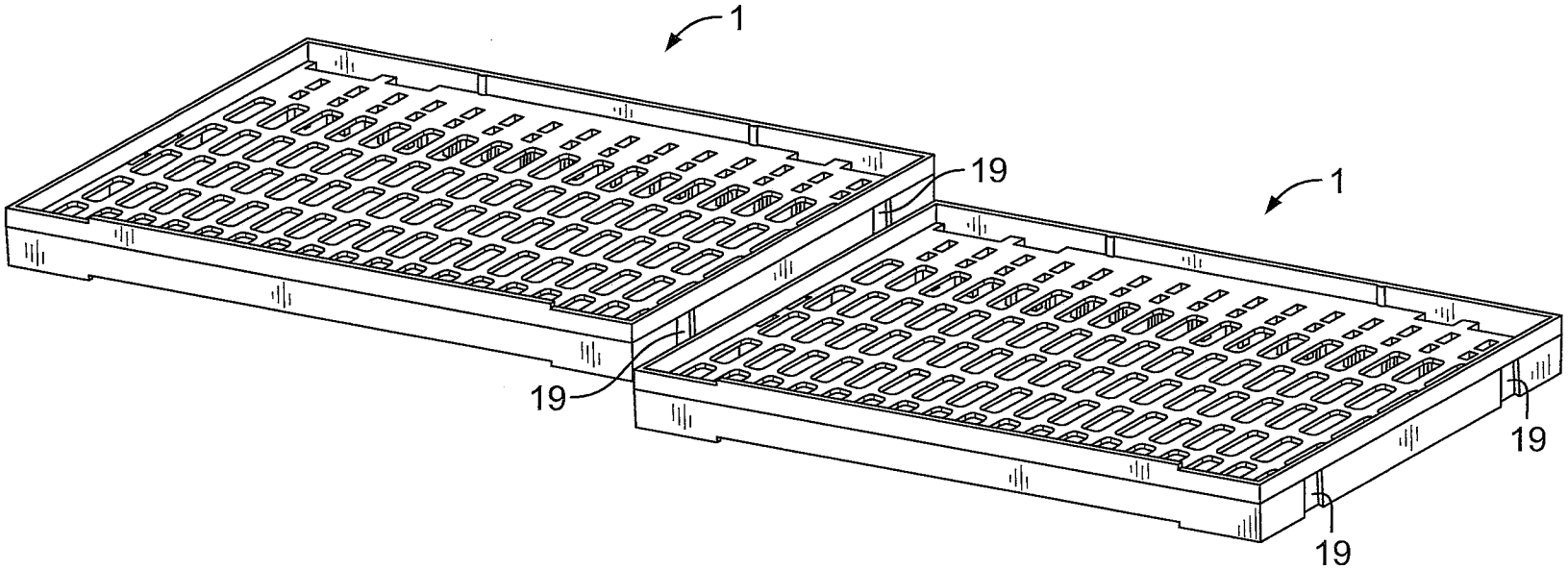
FIG. 9 shows a perspective view of two adjacent display unit trays in accordance with an embodiment of the invention.

The display unit trays may include dovetail connectors 18, 19 to facilitate joining trays of adjacent display units. The dovetail connectors may include a first or male dovetail connector 18 projecting outwardly from a first tray first side wall 13, as shown for example in FIG. 7. The dovetail connectors may further include a second or female dovetail connector 19 projecting into a first tray second side wall 14, as shown for example in FIG. 6. FIGS. 8 and 9 show a detailed view of male 18 and female 19 dovetail connectors being used to connect adjacent trays 1 in a side by side manner. In this way, adjacent display units can be joined together.

As shown in FIGS. 1 and 2, the display unit may further include an optional middle shelf assembly 30 to accommodate additional items of merchandise. Although the optional middle shelf assembly 30 is illustrated incorporated into the counter top display unit configuration in FIGS. 1 and 2, middle shelf assembly 30 can also be incorporated into the free standing floor stand display unit configuration shown in FIGS. 3 and 4.

The optional middle shelf assembly may include a middle shelf 31 suspended from an upper or second tray 2 by a plurality of middle shelf supports 32. Middle shelf supports 32 may be elongated members having a substantially square upper flange or head at an upper terminal end thereof and a larger, substantially rectangular lower flange or foot at a lower terminal end thereof. To install the middle shelf 31, a middle shelf support 32 may be inserted through an opening provided in one corner of the middle shelf 31 and rotated 90 degrees so that the lower flange or foot prevents the middle shelf support 32 from passing through the smaller opening. The upper flange or head is inserted through a corresponding hole in second shelf 2 and slid over to secure the middle shelf support 32 in place. This procedure is repeated for the remaining three corners of the middle shelf 31 and the middle shelf 31 is pressed downward to ensure all of the middle shelf supports 32 are level and properly engaged.

The display unit may further include a shelf channel 50 disposed on at least one of the first tray front wall 11 and the second tray front wall 21. Shelf channel 50 is configured to receive and display a graphic card which typically includes information regarding the merchandise supported on the associated tray or shelf.

The display unit may further include a header 60 suspended above and/or secured to a second or uppermost tray 2 using at least one header support wire 61. As shown for example in FIGS. 1-4, the header 60 may include upper and/or lower channels for receiving a graphic card or sheet to be displayed. The header support wires 61 may be inserted into header sockets or brackets 62 disposed on a rear face of header 60 and then aligned with holes provided in the upper tray or shelf and pressed firmly into place. Although the header 60 as illustrated is mounted to a rear side of the display unit upper tray, the header may optionally be mounted to a front side of the display unit upper tray. The header 60 may be installed at the front or back of the display unit in a high or low configuration. Shorter header support wires may be provided for mounting the header 60 to a front of the display unit.

Figure 10:
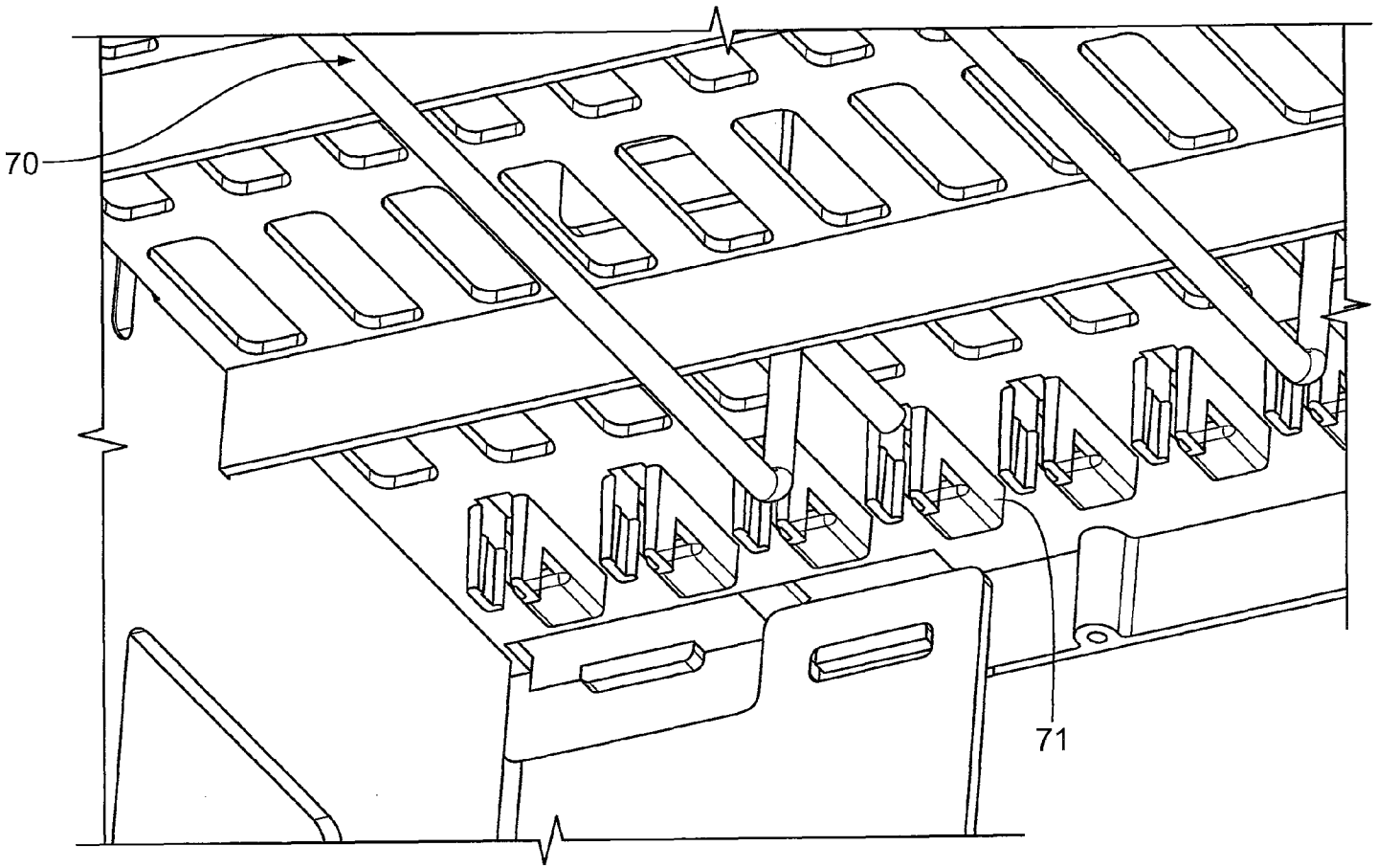
FIG. 10 shows a detailed perspective view of an underside of a display unit tray having molded brackets and product support bars engaging therein.

One or more product support bars (wires) or peg hooks 70 for hanging merchandise to be displayed may be secured to one or more second or upper tray 2 underside surfaces 26. As shown for example in FIG. 10, a plurality of molded brackets 71 may be provided at an underside of the tray for receiving associated product support bars 70. The product support bars 70 may have an offset design such that a terminal end of the product support bar 70 is inserted into an associated molded bracket 71 and snapped into place to provide a secure fit.

While a number of embodiments of the present invention has been shown and described, it is to be understood that many changes and modifications may be made thereunto without departing from the spirit and scope of the invention as defined in the appended claims.

LISTING OF REFERENCE NUMERALS

1 first tray
2 second tray
10 first vertical support member
11 first tray front wall
12 first tray rear wall
13 first tray first side wall
14 first tray second side wall
15 first tray upper merchandise support surface
16 first tray underside surface
17 first tray plurality of tab receiving slots
18 male dovetail connector
19 female dovetail connector
20 second vertical support member
21 second tray front wall
22 second tray rear wall
23 second tray first side wall
24 second tray second side wall
25 second tray upper merchandise support surface
26 second tray underside surface
27 second tray plurality of tab receiving slots
30 shelf assembly
31 middle shelf
32 middle shelf supports
40 legs
50 shelf channel
60 header
61 header support wires
62 header brackets
70 product support bar (wire)
71 molded bracket
101 first vertical support member side panel
102 first vertical support member rear panel
103 plurality of first vertical support member lower tabs
104 plurality of first vertical support member upper tabs
105 opening in vertical support member side panel
106 strengthening rib
201 second vertical support member side panel
202 second vertical support member rear panel
203 plurality of second vertical support member lower tabs
204 plurality of second vertical support member upper tabs

What is claimed is:

1. A display unit comprising:

a) a first tray comprising:
- i) a first tray front wall;
- ii) a first tray rear wall;
- iii) a first tray first side wall;
- iv) a first tray second side wall;
- v) a first tray upper merchandise support surface;
- vi) a first tray underside surface; and
- vii) a first tray plurality of tab receiving slots;

b) a second tray disposed over and spaced apart from said first tray, said second tray comprising:
- i) a second tray front wall;
- ii) a second tray rear wall;
- iii) a second tray first side wall;
- iv) a second tray second side wall;
- v) a second tray upper merchandise support surface;
- vi) a second tray underside surface; and
- vii) a second tray plurality of tab receiving slots;

c) a first vertical support member disposed between said first tray and said second tray, said first vertical support member comprising:
- i) a first vertical support member side panel running substantially parallel and adjacent to said first tray first side wall and said second tray first side wall and extending between said first tray upper merchandise support surface and said second tray underside surface;
- ii) a first vertical support member rear panel hingedly coupled to said first vertical support member side panel, said first vertical support member rear panel running substantially parallel and adjacent to said first tray rear wall and said second tray rear wall and extending between said first tray upper merchandise support surface and said second tray underside surface, wherein said first vertical support member side panel is wider than said first vertical support member rear panel;

iii) a plurality of first vertical support member lower tabs disposed on a lower portion of said first vertical support member, each of said plurality of first vertical support member lower tabs engaging an associated tab receiving slot of said first tray plurality of tab receiving slots; and iv) a plurality of first vertical support member upper tabs disposed on an upper portion of said first vertical support member, each of said plurality of first vertical support member upper tabs engaging an associated tab receiving slot of said second tray plurality of tab receiving slots;

d) a second vertical support member disposed between said first tray and said second tray, said second vertical support member comprising:

i) a second vertical support member side panel running substantially parallel and adjacent to said first tray second side wall and said second tray second side wall and extending between said first tray upper merchandise support surface and said second tray underside surface;

ii) a second vertical support member rear panel hingedly coupled to said second vertical support member side panel, said second vertical support member rear panel running substantially parallel and adjacent to said first tray rear wall and said second tray rear wall and extending between said first tray upper merchandise support surface and said second tray underside surface;

iii) a plurality of second vertical support member lower tabs disposed on a lower portion of said second vertical support member, each of said plurality of second vertical support member lower tabs engaging an associated tab receiving slot of said first tray plurality of tab receiving slots; and iv) a plurality of second vertical support member upper tabs disposed on an upper portion of said second vertical support member, each of said plurality of second vertical support member upper tabs engaging an associated tab receiving slot of said second tray plurality of tab receiving slots; and e) a middle shelf suspended from said second tray by a plurality of middle shelf supports.

2. The display unit according to claim 1, wherein said plurality of first vertical support member lower tabs comprise a plurality of first vertical support member side panel lower tabs disposed on a lower portion of said first vertical support member side panel;

said plurality of first vertical support member upper tabs comprise a plurality of first vertical support member side panel upper tabs disposed on an upper portion of said first vertical support member side panel; and said plurality of first vertical support member side panel lower tabs are arranged offset from said first vertical support member side panel upper tabs.

3. The display unit according to claim 1, wherein said first vertical support member side panel has an opening therethrough.

4. The display unit according to claim 1, wherein said first vertical support member comprises a strengthening rib.

5. The display unit according to claim 1, further comprising a first dovetail connector disposed on said first tray first side wall and a second dovetail connector disposed on said first tray second side wall.

6. The display unit according to claim 5, wherein said first dovetail connector comprises a male dovetail connector projecting outwardly from said first tray first side wall and said second dovetail connector comprises a female dovetail connector projecting into said first tray second side wall.

7. The display unit according to claim 1, further comprising a plurality of legs extending downwardly from said first tray underside surface.

8. The display unit according to claim 1, further comprising a shelf channel disposed on at least one of said first tray front wall and said second tray front wall.

9. The display unit according to claim 1, further comprising a header secured to said second tray.

10. The display unit according to claim 9, wherein said header is suspended above said second tray with at least one header support wire.

11. The display unit according to claim 1, further comprising a plurality of product support bars secured to said second tray underside surface.

12. The display unit according to claim 11, further comprising a plurality of molded brackets for receiving an associated product support bar of said plurality of product support bars.

13. The display unit according to claim 1, wherein said plurality of middle shelf supports comprises a plurality of elongated members, each of said plurality of elongated members comprising a substantially square upper flange at an upper terminal end thereof and a larger, substantially rectangular lower flange at a lower terminal end thereof, wherein each of said plurality of middle shelf supports is inserted through a respective opening provided in said middle shelf and rotated 90 degrees so that said substantially rectangular lower flange prevents said middle shelf support from passing through the respective opening provided in the middle shelf and said substantially square upper flange is inserted through a respective hole provided in said second shelf and slid over to secure said middle shelf support in place.

* * * * *